US005623719A

United States Patent [19]

De Cock et al.

[11] Patent Number: 5,623,719

[45] Date of Patent: Apr. 22, 1997

[54] GUIDING OR REVERSING ROLLER ARRANGEMENT FOR AN ELECTROSTATOGRAPHIC IMAGE REPRODUCTION APPARATUS

[75] Inventors: Etienne M. De Cock; Lucien A. De Schamphelaere, both of Edegem; Erik G. G. Van Weverberg, Mortsel, all of Belgium

[73] Assignee: XEIKON NV, Mortsel, Belgium

[21] Appl. No.: 398,894

[22] Filed: Mar. 6, 1995

[30] Foreign Application Priority Data

Apr. 5, 1994 [EP] European Pat. Off. ..... 94302399.4

[51] Int. Cl.[6] ..... G03G 15/00

[52] U.S. Cl. ..... 399/299; 355/26; 399/364

[58] Field of Search ..... 355/279, 210, 355/326 R, 219, 319, 308, 309, 26–29, 90

[56] References Cited

U.S. PATENT DOCUMENTS

| | | | |
|---|---|---|---|
| 3,645,615 | 2/1972 | Spear, Jr. | 355/319 |
| 3,694,073 | 9/1972 | Bhagat | 355/26 X |
| 3,847,478 | 11/1974 | Young | 355/274 |
| 4,095,979 | 6/1978 | DiFrancesco et al. | 355/26 X |
| 4,261,661 | 4/1981 | Thiers | 355/319 X |
| 4,609,279 | 9/1986 | Hausmann et al. | 355/308 |
| 4,884,104 | 11/1989 | Yoshida | 355/210 |
| 4,935,785 | 6/1990 | Wildi et al. | 355/290 |
| 5,455,668 | 10/1995 | De Bock et al. | 355/326 R |
| 5,461,470 | 10/1995 | De Cock et al. | 355/326 R |
| 5,499,093 | 3/1996 | Aerens et al. | 355/326 R |
| 5,506,671 | 4/1996 | Buts et al. | 355/326 R |

FOREIGN PATENT DOCUMENTS 61-251885 11/1986 Japan .

*Primary Examiner*—Shuk Yin Lee

*Attorney, Agent, or Firm*—Brumbaugh, Graves, Donohue & Raymond

[57] ABSTRACT

Electrostatographic image reproduction apparatus forms images of toner particles on a receptor material moving along a transport path. A rotatable contact roller contacts the receptor material while it has an electrostatically charged toner particle image on at least the adjacent surface thereof. The contact roller is selected from a receptor material transport roller, a guiding roller, and a reversing roller. Electrostatic charging device provide an electrostatic charge, having the same polarity as the charge polarity of the toner particles, on the surface of the contact roller before contact of the receptor material with the surface of the contact roller. Cleaning means remove any toner particles from the surface of the roller after release of the receptor material from the surface of the contact roller. Smudging of the toner image on the receptor material is reduced.

15 Claims, 5 Drawing Sheets

GUIDING OR REVERSING ROLLER ARRANGEMENT FOR AN ELECTROSTATOGRAPHIC IMAGE REPRODUCTION APPARATUS

FIELD OF THE INVENTION

The present invention relates to an electrostatographic image reproduction apparatus for forming images of toner particles on a receptor material moving along a receptor material path, in particular to a printer capable of printing color images for professional purposes as a cost effective alternative to conventional printing of short to medium sized runs. By "image reproduction apparatus" in the context of the present invention, we mean a copying or printing apparatus.

BACKGROUND TO THE INVENTION

Electrostatographic printing operates according to the principles and embodiments of non-impact printing as described e.g., in "Principles of Non-Impact Printing" by Jerome L Johnson (1986)—Palatino Press—Irvine Calif., 92715 USA).

Electrostatographic printing includes electrographic printing in which an electrostatic charge is deposited image-wise on a dielectric recording member as well as electrophotographic printing in which an overall electrostatically charged photoconductive dielectric recording member is image-wise exposed to conductivity increasing radiation producing thereby a "direct" or "reversal" toner-developable charge pattern on said recording member. "Direct" development is a positive-positive development, and is particularly useful for reproducing pictures and text. "Reversal" development is of interest in or when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (e.g. printed text) in such a way that the light information corresponds with the graphic characters so that by "reversal" development in the exposed area of a photoconductive recording layer, toner can be deposited to produce a positive reproduction of the electronically stored original. In high speed electrostatographic printing the exposure derives practically always from electronically stored, i.e. computer stored information.

As used herein, the term "electrostatographic" also includes the direct image-wise application of electrostatic charges on an insulating support, for example by ionography.

Copying at both sides of the copying material or printing stock is favored for economic reasons.

Duplex printing is common practice in classical printing with liquid printing ink, as e.g. in offset printing of books and journals.

In electrostatography several techniques are known for forming duplex images on a final support medium such as a web or copy sheet. A survey of such techniques is given in U.S. Pat. No. 4,095,979 (Di Francesco et al. assigned to Eastman Kodak Company), which relates in particular to duplex copying by means of a photoconductive recording member.

Although most electrophotographic copiers have the capability of reproducing information on both sides of a copy sheet it is not an easy result to accomplish.

In a non-complicated embodiment described in U.S. Pat. No. 3,645,615 (Spear assigned to Xerox Corporation), the copy sheet is redirected into the feed tray of the machine after the first side of the original has been copied to receive a print of the second side of the original on the still blank side. Special paper sheet feed systems have been developed to enable duplex printing at both sides of copy sheets (see for example U.S. Pat. Nos. 4,095,979 and 4,261,661). Normally, a paper sheet reversing or turner mechanism makes the paper sheet available for a new copying cycle but now on the opposite side of the paper.

In duplex printing on web-type material likewise reversing or turner mechanisms are applied for reversing the web and feeding it into a next printing station [see for example "The Printing Industry" by Victor Strauss, published by Printing Industries of America Inc, 20 Chevy Chase Circle, NW, Washington D.C. 20015 (1967), p 512–514]. The turnaround of the web to be printed requires an additional turnaround mechanism containing one or more reversing rollers.

It has been recognized e.g. in connection with the electrostatographic duplex printer illustrated in FIG. 1 of U.S. Pat. No. 3,694,073 (Bhagat assigned to Xerox Corporation) that it will be practically impossible to maintain image quality when a toner-laden web-type receptor material comes with one or both of its toner-laden sides into contact with guiding or reversing rollers before sufficient fixing of the roller-contacting toner image has taken place.

Experiments carried out by us revealed that the problem of transfer of unfixed toner to a contacting roller (guiding or reversing roller) can be solved in the way making subject of the present invention.

SUMMARY OF THE INVENTION

It is an object of the present invention to provide an electrostatographic copying or printing apparatus in which the quality of a toner image is practically not impaired by contact of a toner receptor element through its non-fixed or incompletely fixed toner particles with a contact roller surface before complete fixing of the toner image.

It is a preferred object of the present invention to provide an electrostatographic single-pass multiple station duplex printer for sequentially or simultaneously forming toner particle images on both sides of a web serving as toner receptor element, which printer contains a web reversing mechanism adapted for counteracting toner particle transfer onto a web-reversing roller before final fixing of the toner particles takes place.

According to the present invention there is provided an electrostatographic image reproduction apparatus for forming images of toner particles on a receptor material moving along a receptor material path, which apparatus comprises a rotatable contact roller for contacting the receptor material while it has an electrostatically charged toner particle image on at least that surface thereof which is adjacent said contact roller, wherein said contact roller is selected from a receptor material transport roller, a guiding roller and a reversing roller, characterized in that said contact roller is associated with electrostatic charging means capable of providing on the surface of said contact roller an electrostatic charge having the same polarity as the charge polarity of the toner particles on the adjacent surface of said receptor material before contact of said receptor materia with the surface of said contact roller.

In preferred embodiments of the invention, the contact roller is also associated with cleaning means for removing any toner particles from the surface of said roller after release of the receptor material from the surface of said contact roller.

The receptor material may be in the form of a sheet or a web.

The contact roller is a receptor material transport roller, a guiding roller or a reversing roller, but we have found that the present invention is particularly beneficially applicable to the contact roller being a reversing roller. Where the contact roller is a reversing roller, the wrapping angle of the receptor material about the roller will be greater than 90°. It is possible for a number of reversing rollers to be provided in series, in which case the total of the wrapping angles about these rollers will be greater than 90°.

The contact roller preferably comprises an electrically insulating surface coating. We prefer that this surface coating is smooth and in particular comprises an abhesive material. When the contact roller has an electrically insulating surface, said electrostatic charging means may suitably comprise a corona charge device arranged for directing its corona flux to the electrically insulating surface of the contact roller, said contact roller being earthed or at a fixed potential with respect to said corona charge device. As an alternative, the electrostatic charging means may be a brush in contact with the contact roller, relative movement between the brush and the roller surface causing the generation of electrostatic charge on the surface of the contact roller.

The cleaning means is preferably located upstream of said charging means, considered in the direction of rotation of the contact roller. The cleaning means may include a cleaning brush capable of rotating in the same rotational sense as the contact roller. A scraper device may alternatively be used as the cleaning means.

A pair of corona charge devices may be located upstream of said contact roller, one on either side of the receptor material path to ensure that the toner particles on opposite sides of the receptor material carry opposite electrostatic charges.

In a preferred embodiment of the invention, a direct current charge corona is arranged for directing its corona charge flux towards the receptor material in the zone wherein the receptor material contacts the surface of the contact roller, and an alternating current corona device is arranged for directing its corona discharge flux towards the receptor material substantially at the position where said receptor material leaves the surface of the contact roller.

The electrostatically charged toner particle image on the receptor material is unfixed or incompletely fixed and the apparatus will therefor usually include a toner image-fixing device is located downstream of the contact roller, although it is also possible to include a pre-fixing device upstream of the contact roller to partially fix the toner image onto the receptor material. The present invention however reduces the necessity for such pre-fixing.

The apparatus is suitably a printer which comprises:

at least one toner image-producing electrostatographic station having rotatable endless surface means onto which a toner image can be formed;

means for conveying a receptor material in the form of a web past said station;

means for controlling the speed and tension of the web while it is running past said station;

guiding means which determine for the web a wrapping angle about the rotatable surface means; and transfer means for transferring the toner image on the rotatable surface means onto the web, the adherent contact of the web with said rotatable endless surface means being such that the movement of the web controls the peripheral speed of said surface means in synchronism with the movement of the web.

In particular, the invention is particularly beneficially applicable to a single-pass multiple station printer for forming an image onto a web, which printer comprises a plurality of such toner image-producing electrostatographic stations, the web being conveyed in succession past said stations.

In one embodiment of the invention said image-producing stations are arranged in two sub-groups that are passed in succession by the moving web, one sub-group forming an image on one web side and the other sub-group forming an image on the other web side, thereby to enable sequential duplex printing.

In another embodiment of the invention, said image-producing stations are arranged in two sub-groups, the rotatable surface means of one sub-group forming guide roller means for the other sub-group, and vice-versa, thereby to enable simultaneous duplex printing.

PREFERRED EMBODIMENTS OF THE INVENTION

The invention will now be further described, purely by way of example, with reference to the accompanying drawings in which.

The accompanying drawings relate to electrostatographic toner image formation on a web-type, e.g. paper printing stock, receptor material without, however, limiting it thereto.

Figure 1A:
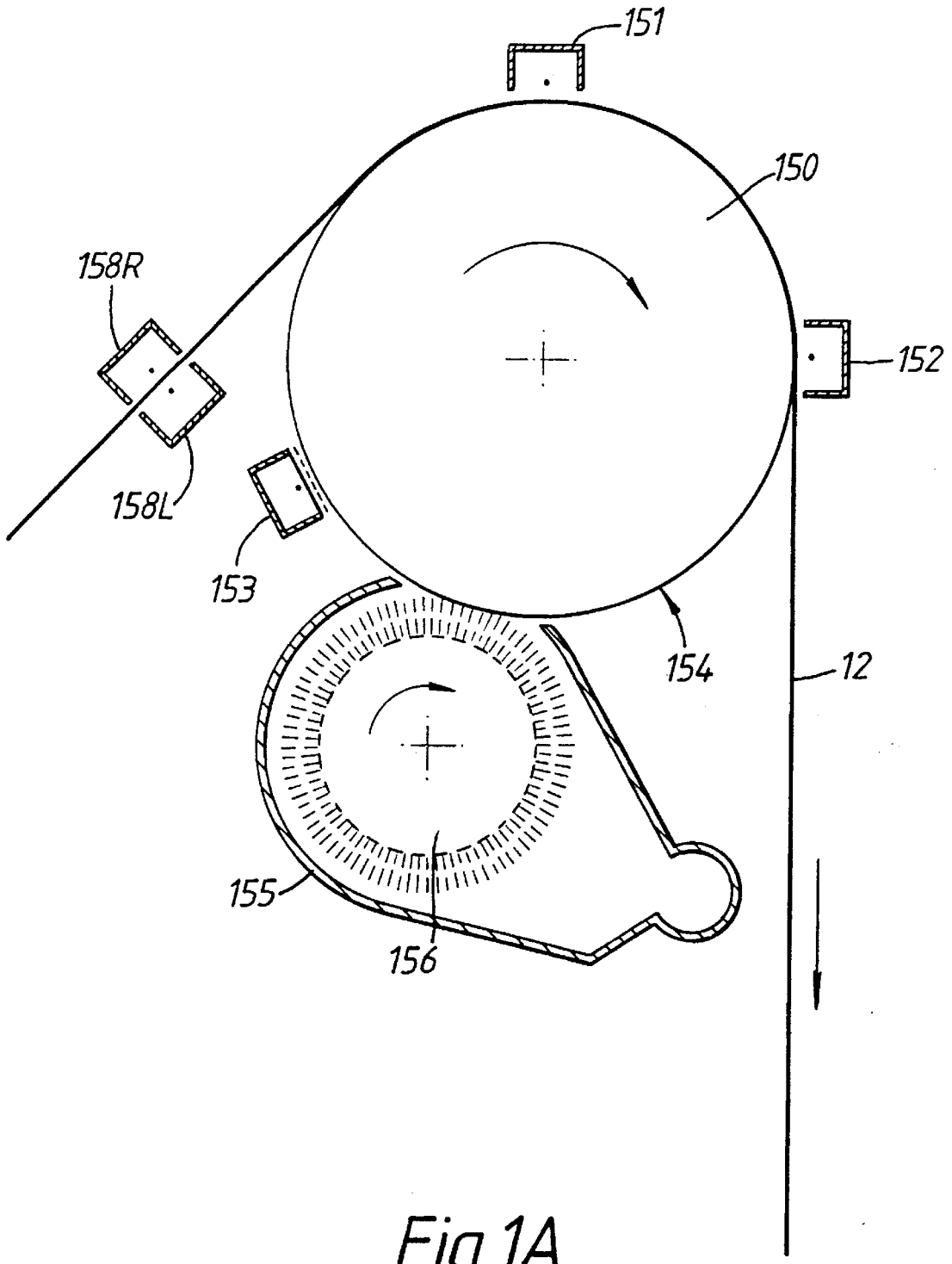
FIG. 1A shows a reversing roller arranged in conjunction with several means for counteracting toner image distortion on a web before final fixing of the toner particles on said web.

In the embodiment shown in FIG. 1A a receptor material web 12 moves along a web transport path over a freely rotatable reversing roller 150. The reversing roller 150 has an electrically conductive core and is coated with an electrically insulating material, preferably a smooth and abhesive material, such as a highly fluorinated polymer, preferably TEFLON (tradename), allowing electrostatic charging by corona. The roller surface 154 has no or poor adhesion with respect to the toner particles.

The wrapping angle of the web about the reversing roller 150 is about 135°. The web 12 carries an electrostatically charged toner image on both sides thereof. The linear movement of web 12 is maintained in synchronism with the peripheral speed of the surface of the reversing roller 150 by virtue of the fact that the latter is freely rotatable. A potential difference between the roller 150 and the web 12 is obtained by means of corona charging device 151 driven by direct current. The web 12 is therefore electrostatically attracted over the contacting zone of web and roller, so that the roller 150, being at a fixed potential, preferentially at earth potential, is driven by web 12 and no slippage takes place, so that no smearing of the toner image could take place.

A discharging corona device 152 operated with alternating current, enables easy release of the web 12 from the roller surface 154.

According to the embodiment illustrated in FIG. 1A, upstream of the reversing roller 150 the web 12 passes between a pair of corona charge devices 158R, 158L of opposite polarity. Hereby, the toner particles carried on the outer surface of the web 12, which surface does not contact the reversing roller 150, obtain a polarity the same as the polarity of the corona charge flux of the corona 151.

While the pair of corona devices 158L, 158R may be constituted by DC coronas of opposite polarity, however, since a negative DC corona tends to produce a non-uniform discharge along its length, it is advantageous to replace in said pair the negative DC corona by an AC corona device. This AC corona in combination with a positive DC corona at the opposite side of the paper web 12 produces a net negative charge that is more uniform.

The transfer of toner particles to the reversing roller 150 that is earthed or at a fixed potential, is counteracted by charging the roller surface 154 with corona 153, preferably a scorotron, before contacting the web 12 carrying the toner images. The charge polarity of said corona 153 is the same as the polarity of the toner particles that will come into contact with the roller surface 154.

Any residual toner that may cling to the roller surface 154 after release of the web 12 from the roller 150, will be removed by means of a cleaning device 155. The cleaning device 155 includes a cleaning brush 156 which rotates in the same rotational sense as the reversing roller 150. The cleaning brush 156 is earthed or subject to such a potential that adhering residual toner particles are attracted away from the roller surface 154.

Figure 1B:
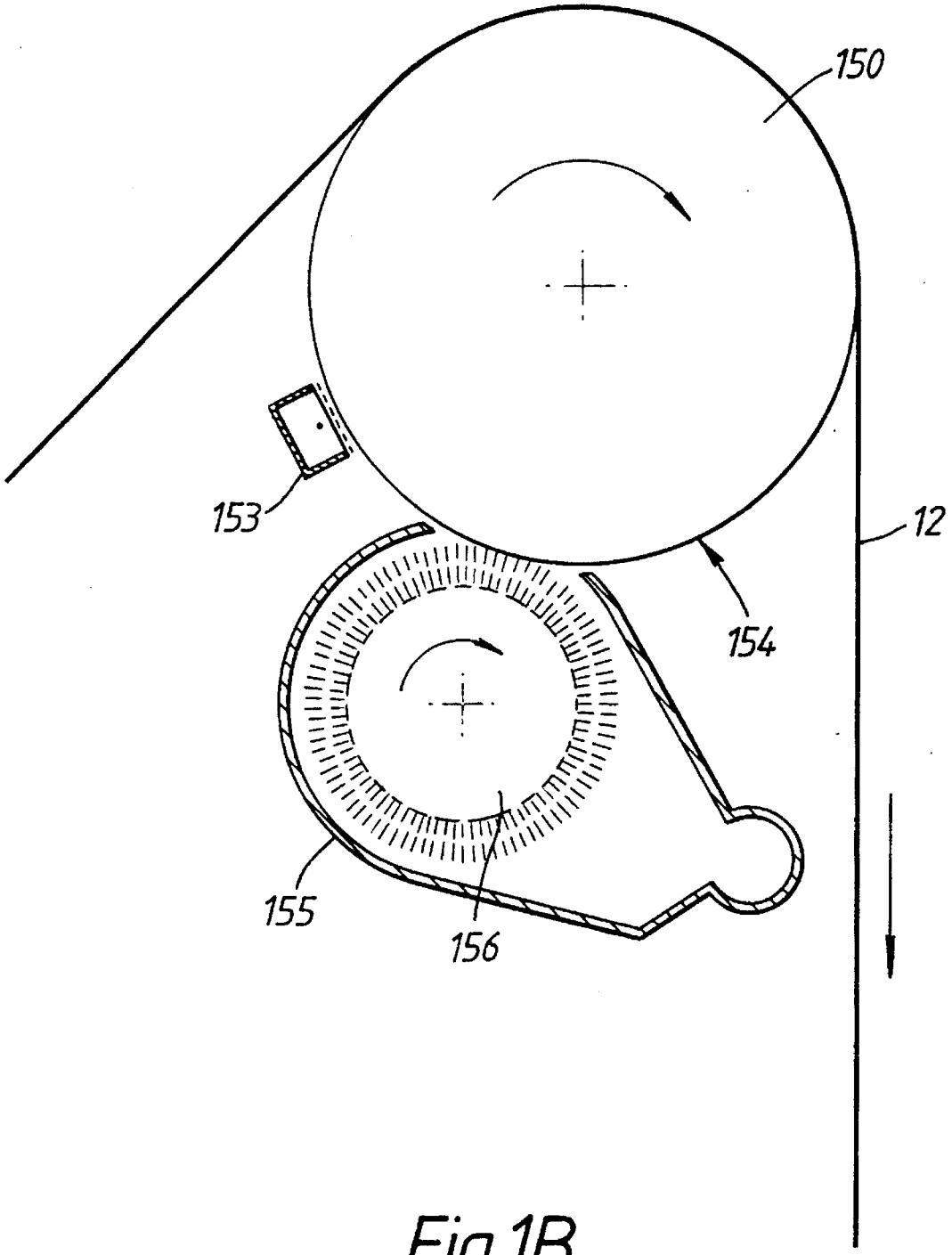
FIG. 1B shows a reversing roller arranged in conjunction with a simpler arrangement of means for counteracting toner image distortion on a web before final fixing of the toner particles on said web.

In the alternative embodiment as shown in FIG. 1B, by sufficiently mechanically tensioning the web 12 on the reversing roller 150, the coronas 151 and 152 providing electrostatic attraction and release between the web and roller may be dispensed with. Further, in case the toner particles that will come into contact with the surface of the reversing roller 150, have a charge level sufficiently high and of opposite polarity to the corona charge of corona device 153, the corona pair 158R, 158L can be left out without giving rise to a significant image smudging by the reversing roller surface 154.

Figure 2:
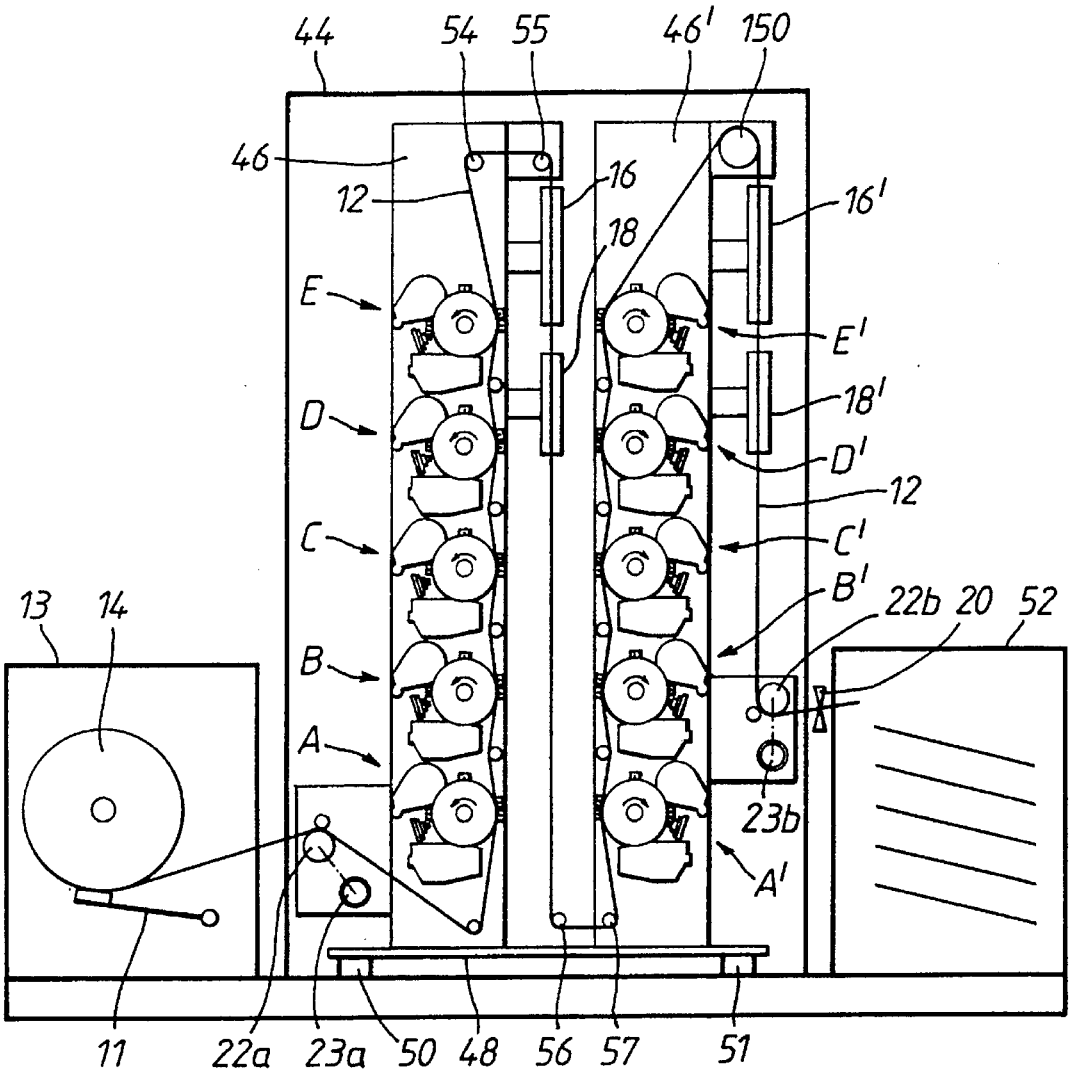
FIG. 2 represents a section of an electrostatographic printer capable of sequential duplex printing.

Referring to FIG. 2, there is shown a printer for sequential duplex printing having a supply station 13 in which a roll 14 of web material 12 is housed, in sufficient quantity to print, say, up to 5,000 images. The web 12 is conveyed into a tower-like printer housing 44 in which two support columns 46 and 46' are provided, housing four similar printing stations A to D and A' to D' respectively. In addition, a further stations E and E' are provided in order to optionally print an additional color, for example a specially customized color, for example white. The printing stations are mounted in a substantially vertical configuration resulting in a reduced footprint of the printer and additionally making servicing easier. The columns 46 and 46' may be mounted against vibrations by means of a platform 48 resting on springs 50, 51.

After leaving the final printing station E, the image on one side of the web is fixed by means of the image-fixing station 16, and the web 12 passes through a cooling zone 18. The web 12 is conveyed through the printer by two drive rollers 22*a*, 22*b* one positioned between the supply station 13 and the first printing station A and the second positioned between the image-fixing station 16' and the cutting station 20 (schematically represented) and a stacker 52 if desired. Tension in the web is generated by the application of a brake 11 acting upon the supply roller 14. The drive rollers 22*a*, 22*b* are driven by controllable motors, 23*a*, 23*b*. One of the motors 23*a*, 23*b* is speed controlled at such a rotational speed as to convey the web through the printer at the required speed, which may for example be about 125 mm/sec. The other motor is torque controlled in such a way as to generate a web tension of, for example, about 1N/cm web width.

After leaving the printing station E the web passes over a pair of upper direction-reversing rollers 54, 55 before entering the first image-fixing station 16. Towards the bottom of the printer the web 12, with a fixed image on one face, passes over lower direction-reversing rollers 56, 57 to enter the second column 46' from the bottom. The web 12 then passes the printing stations A' to E' where a second image is printed on the opposite side of the web the path of which is reversed by reversing roller 150 that is associated with means illustrated in FIG. 1A or 1B for counteracting toner-deposition on the surface thereof. The second image is fixed by the image-fixing station 16'.

Figure 2A:
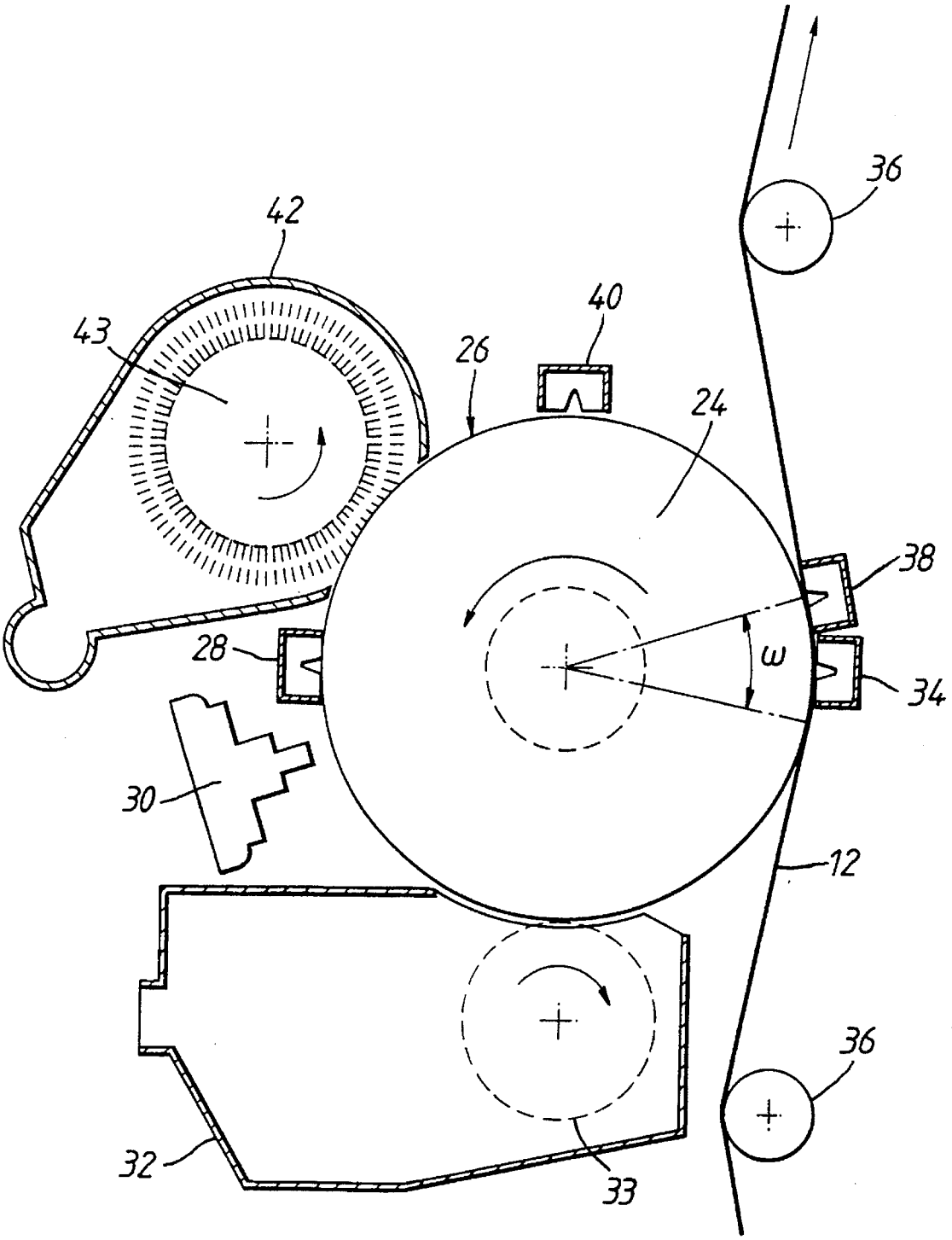
FIG. 2A shows in detail a cross-section of one of the print stations of the printer shown in FIG. 2.

As shown in FIG. 2A, each printing station comprises a cylindrical drum 24 having a photoconductive outer surface 26. Circumferentially arranged around the drum 24 there is a main corotron or scorotron charging device 28 capable of uniformly charging the drum surface 26, for example to a potential of about −600 V, an exposure station 30 which may, for example, be in the form of a scanning laser beam or an LED array, which will image-wise and line-wise expose the photoconductive drum surface 26 causing the charge on the latter to be selectively reduced, for example to a potential of about −250 V, leaving an imagewise distribution of electric charge to remain on the drum surface 26. This so-called "latent image" is rendered visible by a developing station 32 which by means known in the art will bring a developer in contact with the drum surface 26. The developing station 32 includes a developer drum 33 which is adjustably mounted, enabling it to be moved radially towards or away from the drum 24 for reasons as will be explained further below. According to one embodiment, the developer contains (i) toner particles containing a mixture of a resin, a dye or pigment of the appropriate color and normally a charge-controlling compound giving triboelectric charge to the toner, and (ii) carrier particles charging the toner particles by frictional contact therewith. The carrier particles may be made of a magnetizable material, such as iron or iron oxide. In a typical construction of a developer station, the developer drum 33 contains magnets carried within a rotating sleeve causing the mixture of toner and magnetizable material to rotate therewith, to contact the surface 26 of the drum 24 in a brush-like manner. Negatively charged toner particles, triboelectrically charged to a level of, for example 9 μC/g, are attracted to the photo-exposed areas on the drum surface 26 by the electric field between these areas and the negatively electrically biased developer so that the latent image becomes visible.

After development, the toner image adhering to the drum surface 26 is transferred to the moving web 12 by a transfer corona device 34. The moving web 12 is in face-to-face contact with the drum surface 26 over a wrapping angle ω of about 15° determined by the position of guide rollers 36. The charge sprayed by the transfer corona device, being on the opposite side of the web to the drum, and having a polarity opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about 3 mA/cm web width. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not tend to wrap around the drum beyond the point dictated by the positioning of a guide roller 36 and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to a level of, for example −580 V, by a pre-charging corotron or scorotron device 40. The pre-charging makes the final charging by the corona 28 easier. Thereby, any residual toner which might still cling to the drum surface may be more easily removed by a cleaning unit 42 known in the art. Final traces of the preceding electrostatic image are erased by the corona 28. The cleaning unit 42 includes an adjustably mounted cleaning brush 43, the position of which can be adjusted towards or away from the drum surface 26 to ensure optimum cleaning. The cleaning brush 43 is earthed or subject to such a potential with respect to the drum as to attract the residual toner particles away from the drum surface. After cleaning, the drum surface is ready for another recording cycle.

In the particular embodiment shown in FIG. 2, all components of the printing stations are identical (except for the color of the toner) and this gives both operating and servicing advantages.

Figure 3:
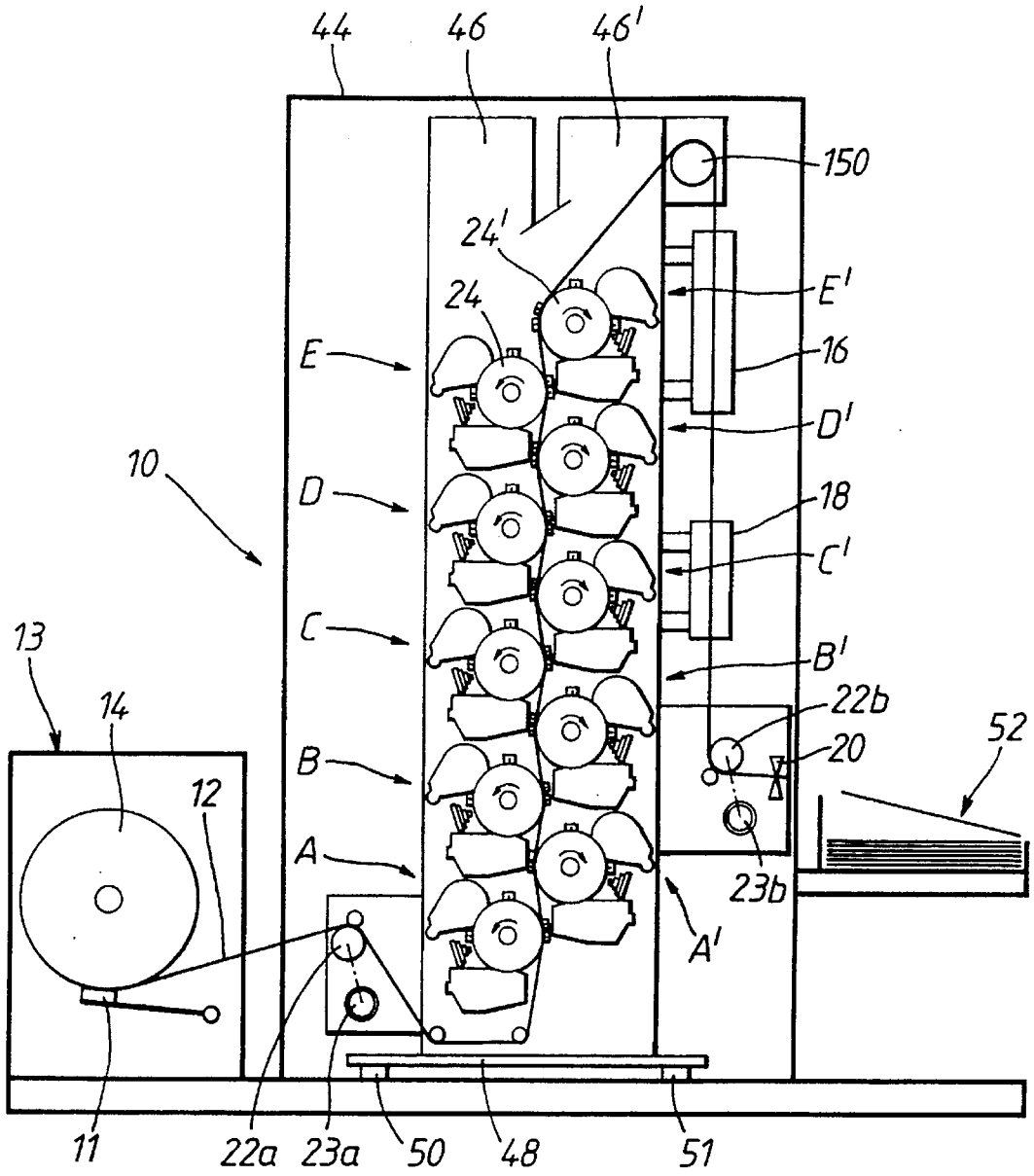
FIG. 3 represents a section of an electrostatographic printer capable of simultaneous duplex printing.

FIG. 3 shows a more compact version of the duplex printer shown in FIG. 2. As in the case of FIG. 2, two columns 46 and 46' are provided each housing printing stations A to E and A' to E' respectively. For the sake of clarity, the columns 46 and 46' are not fully shown in FIG. 3. In contra-distinction to the printer of FIG. 2, the columns 46 and 46' are mounted closely together so that the web 12 travels in a generally vertical path defined by the facing surfaces of the imaging station drums 24, 24'. This arrangement is such that each imaging station drum acts as the guide roller for each adjacent drum by defining the wrapping angle. In the particular embodiment of FIG. 3, there is no need for an intermediate image-fixing station. The arrangement is more compact than the embodiment of FIG. 2. The paper web path through the printer is shorter and this gives advantages in reducing the amount of paper web which is wasted when starting up the printer. By avoiding the use of intermediate heat-fixing no paper distortion will give rise to front-to-back misregistration of the printed images. Although in FIG. 3 the columns 46 and 46' are shown as being mounted on a common platform 48, it is possible in an alternative embodiment for the columns 46 and 46' to be separately mounted, such as for example being mounted on horizontally disposed rails so that the columns may be moved away from each other for servicing purposes and also so that the working distance between the columns may be adjusted.

CROSS-REFERENCE TO CO-PENDING APPLICATIONS

A number of features of the printers described herein are the subject matter of co-pending European patent application Nos. EP-A-629924, EP-A-631204, EP-A-629930 (all Xeikon NV.).

We claim:

1. An electrostatographic image reproduction apparatus for forming images of toner particles on a receptor material moving along a receptor material transport path, comprising a rotatable contact roller having a direction of rotation for contacting said receptor material while it has an electrostatically charged toner particle image having a charge polarity on at least a surface thereof which faces said contact roller, wherein said contact roller is selected from a guiding roller and a reversing roller and comprises a roller surface having an electrically insulating surface coating thereon, wherein said contact roller is associated with electrostatic charging means for providing an electrostatic charge on said roller surface, said electrostatic charge having the same polarity as said charge polarity of the toner particles on said surface of said receptor material before contact of said receptor material with said roller surface.

2. An apparatus according to claim 1, wherein said contact roller is associated with a cleaning means for removing any toner particles from said roller surface after release of said receptor material from said roller surface.

3. An apparatus according to claim 1, wherein said receptor material is in a form selected from sheet form and web form.

4. An apparatus according to claim 2, wherein said cleaning means is located upstream of said charging means, considered in said direction of rotation of said contact roller.

5. An apparatus according to claim 1, wherein said contact roller has an electrically insulating surface and said electrostatic charging means comprises a corona charge device arranged for directing its corona flux to said electrically insulating surface of said contact roller, said contact roller being earthed.

6. An apparatus according to claim 1, wherein said contact roller has an electrically insulating surface and said electrostatic charging means comprises a corona charge device arranged for directing its corona flux to said electrically insulating surface of said contact roller, said contact roller being at a fixed potential with respect to said corona charge device.

7. An apparatus according to claim 2, wherein said cleaning means includes a cleaning brush and means for rotating said cleaning brush in the same rotational sense as said contact roller.

8. An apparatus according to claim 1, wherein a pair of corona charge devices are located upstream of said contact roller, with respect to said direction of rotation, one on either side of said receptor material transport path.

9. An apparatus according to claim 1, wherein said electrically insulating surface coating is smooth.

10. An apparatus according to claim 1, wherein said electrically insulating surface coating comprises an abhesive material.

11. An apparatus according to claim 1, wherein said receptor material contacts said roller surface in a contact zone and a direct current charge corona is arranged for directing its corona charge flux towards said receptor material in said contact zone, wherein an alternating current corona device is arranged for directing its corona discharge flux towards said receptor material substantially at the position where said receptor material leaves said roller surface.

12. An apparatus according to claim 1, wherein said electrostatically charged toner particle image on said receptor material is at least incompletely fixed and a toner image-fixing device is located downstream of said contact roller with respect to said direction of rotation.

13. An apparatus according to claim 1, wherein said apparatus is a printer for forming an image onto a web, which printer comprises:

at least one toner image-producing electrostatographic station having a rotatable endless surface onto which a toner image can be formed;

means for conveying said web past said station at a given speed and tension and in adherent contact with said rotatable endless surface;

means for controlling said speed and tension of said web while it is running past said station;

guiding means for determining for said web a wrapping angle about said rotatable surface; and transfer means for transferring said toner image on said rotatable surface onto said web, said adherent contact of said web with said rotatable endless surface being such that movement of said web controls said endless rotatable surface to rotate at a peripheral speed in synchronism with said movement of said web.

14. An apparatus according to claim 13, wherein said image-producing stations are arranged in two sub-group that are passed in succession by said moving web, one sub-group forming an image on one web side and the other sub-group forming an image on the other web side, thereby to enable sequential duplex printing.

15. An apparatus according to claim 13, wherein said image-producing stations are arranged in two sub-groups, said rotatable surface of one sub-group forming guide roller means for the other sub-group, and vice-versa, thereby to enable simultaneous duplex printing.

* * * * *